United States Patent [19]

Ganz

[11] Patent Number: 4,598,645

[45] Date of Patent: Jul. 8, 1986

[54] RAILWAY TRACK TAMPER

[75] Inventor: Jörg Ganz, Etoy, Switzerland

[73] Assignee: SIG Societe Industrielle Suisse, Neuhausen-Chutes du Rhin, Switzerland

[21] Appl. No.: 674,462

[22] Filed: Nov. 20, 1984

Related U.S. Application Data

[63] Continuation of Ser. No. 447,328, Dec. 6, 1982, abandoned.

[30] Foreign Application Priority Data

Dec. 10, 1981 [CH] Switzerland ..... 7885/81

[51] Int. Cl.[4] ..... E01B 27/16

[52] U.S. Cl. ..... 104/12; 104/10

[58] Field of Search ..... 104/7 R, 7 B, 10, 12, 104/13

[56] References Cited

U.S. PATENT DOCUMENTS

| | | | |
|---|---|---|---|
| 1,231,679 | 7/1917 | Weiss | 104/12 |
| 2,107,639 | 2/1938 | Madison | 104/12 |
| 2,726,871 | 12/1955 | Schnellmann | 104/10 X |
| 2,821,935 | 2/1958 | Bean | 104/12 |
| 3,608,498 | 9/1971 | Plasser et al. | 104/12 |
| 3,901,159 | 8/1975 | Von Beckmann | 104/12 |
| 3,913,490 | 10/1975 | Theurer et al. | 104/12 |
| 4,062,292 | 12/1977 | Derler | 104/12 |
| 4,134,342 | 1/1979 | Sakai et al. | 104/12 |
| 4,258,627 | 3/1981 | Theurer | 104/12 |
| 4,466,355 | 8/1984 | Pasquini | 104/12 |

FOREIGN PATENT DOCUMENTS

| | | |
|---|---|---|
| 344774 | 8/1978 | Austria . |
| 348571 | 2/1979 | Austria . |
| 2060035 | 4/1981 | United Kingdom . |

*Primary Examiner*—Randolph A. Reese

*Attorney, Agent, or Firm*—Anthony J. Casella; Gerald E. Hespos

[57] ABSTRACT

A tamper has tamping tools intended for tamping the open track and the switch gear. Each tool is mounted on an oscillating and pivoting lever (6) and has a fixed pick (20) and a pick (21) displaceable by pivoting in a plane transverse to the track around a shaft (23) which is rigidly connected to the lever (6) and by means of a cylinder (26). The tappets (22) of these picks are offset and partially cover one another in the close-together position and the picks are arched towards the outside so as to leave sufficient space between them for the flow of the ballast above the tappets. The switch gear is tamped in close-together position of the tappets over a reduced length (R) and the open track is tamped in spaced position over a greater length, the stroke of the cylinder (26) limiting and defining these two positions.

4 Claims, 3 Drawing Figures

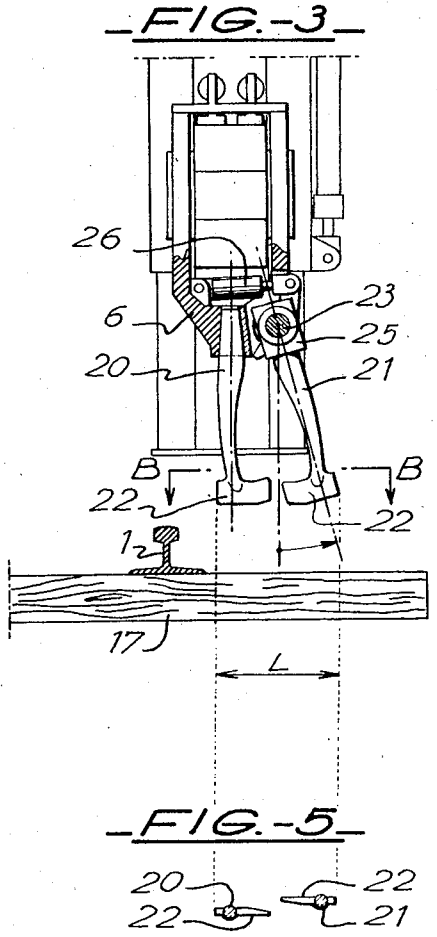
FIG.-3
26
6
20
23
25
21
B
22
1
17
L
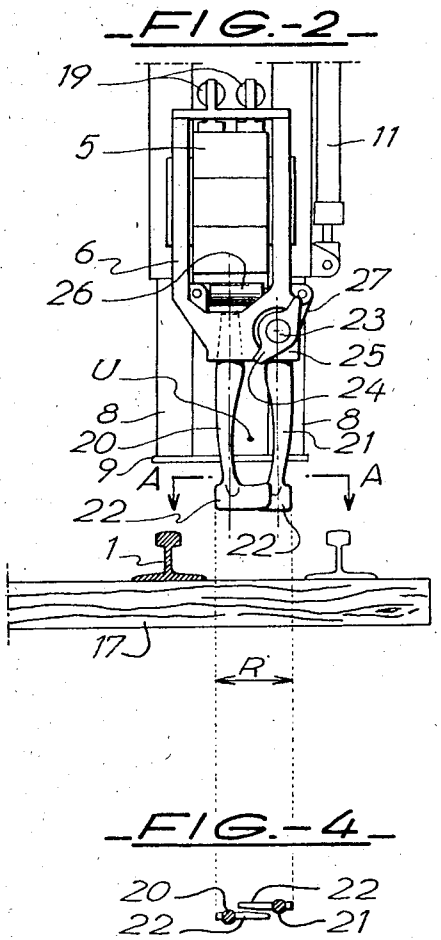
FIG.-2
19
5
6
26
11
27
23
25
24
8
21
A
U
20
9
22
1
17
R
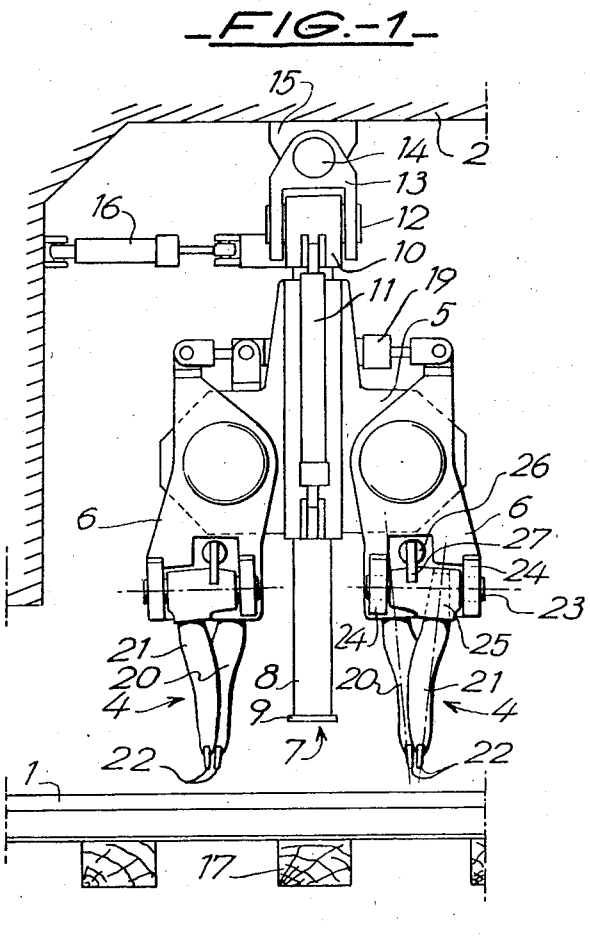
FIG.-1
15
16
2
14
13
12
10
11
19
5
26
6
27
24
23
25
21
4
22
20
8
9
7
17
1
FIG.-4
22
21
20
FIG.-5
22
21
20

RAILWAY TRACK TAMPER

This application is a continuation of application Ser. No. 447,328 filed on Dec. 6, 1982, now abandoned.

The object of the present invention is a railway track tamper of the type adapted to tamp the switch gear as well as the open track.

Tampers which are provided for this purpose with at least one tamping unit which is movable in the direction transverse to the track in order to tamp the track on both sides of each line of rails as well as around the switch gear are already known, said tamping unit comprising a group of two tools mounted opposite each other on a vertically movable carrying frame on which each of these tools is supported by a lever which oscillates and pivots in a plane parallel to the track and on which these tools are formed by picks each provided with an end tappet of a length determined so as to compact the ballast along a limited portion of the ties.

On these tampers, the length of the tappets of the picks of the tamping tools is necessarily limited to a reasonable minimum which permits their insertion between each of the two rails of the track moved along by the tamper and the lateral obstacles encountered at the switch gear and their immediate environment, such as, for instance, those formed by the two lines of rails of the competitive track in a simple switch. The clearance available for this insertion decreases, as a matter of fact, as the rails of the competitive track come closer to those of the track followed by the tamper and the length of the tappets in question determines the limit from which insertion into the ballast is no longer possible, that is to say therefore the limit from which the compacting of the ballast can no longer be effected beneath the ties between these competitive rails. It would therefore be advantageous to reduce this limit by reducing the length of the tappets of the picks to the minimum useful to assure a compacting action under the maximum number of ties between said rails.

On the other hand, on the open track this limitation no longer has any reason for existence in view of the absence of obstacles on the two sides of the lines of rails. From the standpoint of output, it would, rather, be advantageous to have longer tappets in order to assure a more extensive compacting upon each plunge of the tools.

As tampers of the type indicated above are intended for tamping both on the open track and around switch gear, the selection of the length of the tappets of the picks of their tamping tools is thus necessarily dictated by a compromise between two criteria of quantity and quality: sufficiently extensive compacting upon each plunge of the tools below the ties in order to assure them a good seat, and as complete a compacting of the ballast as possible under the maximum number of ties supporting the switch gear.

This compromise necessarily leads to a length of the pick tappets which may prove too short for the open track and too long for the switch gear in order to assure each tamping tool optimum operating qualities in these two uses.

The object of the present invention is to avoid the necessity of applying a compromise solution to these problems while fully satisfying the two said criteria of quantity and quality.

For this purpose, the tamper of the invention is characterized by the fact that each of its tools has at least two picks having tappets which are juxtaposed at least in the direction transverse to the track, the picks being mounted on a common oscillating and pivoting lever on which at least one of them is mounted for displacement by pivoting and/or translation in or by a guide element which is rigidly connected to the lever and causing the said displacement from a close-together position to a spaced position of the end tappets of the picks of each of these tools in the direction transverse to the track.

In this way the length of the compacting which can be effected along a tie upon each plunge of a tool can be modified by moving the tappets of its picks closer towards or further from each other, from a minimum length useful for the tamping of the switch gear to a maximum length useful for tamping on the open track.

In one simple, economical solution one of the picks of a tool can be mounted in fixed position on the oscillating and pivoting lever.

Depending upon the amount of distance desired between the minimum and maximum compacting lengths which can be obtained upon each plunge of the tools, full latitude is made possible by the selection of the number of picks of each tool, by the selection of the length of their tappets, and by the selection of the close-together and spaced positions of the tappets. Thus, for example, for a large distance apart, the tappets of the picks of a tool can be offset and partially mask one another in the longitudinal direction of the track in the close-together position and then completely unmasked in spaced position in the direction transverse to the track.

These various embodiments as well as others which fall within the scope of the invention will become clearly evident from the following description.

The accompanying drawing shows diagrammatically, by way of illustration, three embodiments of the object of the invention as well as six variants:

FIGS. 1, 2 and 3 are a side view and two front views respectively of the first embodiment, these two last-mentioned views showing it in two different configurations;

FIGS. 4 and 5 are a sectional view along the line A—A of FIG. 2 and a sectional view along the line B—B of FIG. 3 respectively;

In all the figures, parts performing the same functions are indicated by the same reference numbers.

Figure 8:
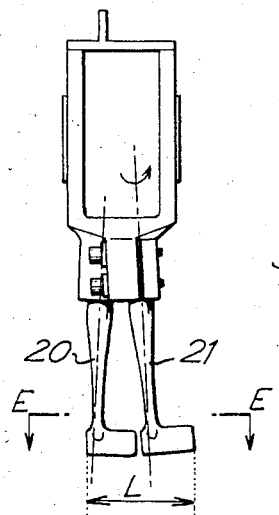
FIGS. 6, 7 and 8 are a side view and two partial front views respectively of the second embodiment, also shown in two different configurations.

The tamping unit which is shown a single time in its entirety in FIG. 1 is of the type adapted to tamp a line of rails 1 from one side. The tamper, only a part of the chassis 2 of which is shown, may have only one or else up to four tampers arranged in pairs above the two lines of rail, according to its purpose.

This tamping unit comprises a group of two tools 4 mounted opposite each other on a vertically movable carrying frame 5 on which each of these tools is supported by a lever 6 oscillating and pivoting in a plane parallel to the track. The carrying frame 5 is mounted for vertical movement in a portal 7 formed of two parallel vertical columns 8 connected at their ends by two horizontal cross members 9 and 10; its movements are controlled by a hydraulic cylinder 11. The portal 7 is connected to the frame 1 of the tamper by an all-azimuth suspension system comprising a double articulation 12–13 and a shaft 14 which slides in the direction transverse to the track and is supported by two spaced hangers 15, only one of which is visible in the drawing, said shaft supporting the double articulation 12–13. This system of suspension of the tamping unit is intended to permit transverse and longitudinal avoidance of obstacles created by the switch gear and comprises operating cylinders connected to the frame 1, only one of which, namely the cylinder 16, has been shown in order not to needlessly clutter the drawing.

Each oscillating and pivoting lever 6 on which a tamping tool 4 is mounted is articulated on the carrying frame 5, which in this case is a housing containing a mechanism for the oscillating of the said lever. The pivoting of the two levers 6 which is intended to assure the closing of the two tamping tools 4 around each tie 17 of the track upon each of the plunges thereof into the ballast is controlled by two hydraulic cylinders 19 which rest against the carrying frame 5 between the two columns 8 of the portal 7.

In the three embodiments shown, each of the tamping tools 4 has two picks 20 and 21 with end tappets 22 juxtaposed in the transverse and longitudinal directions of the track. Pick 20 is mounted in fixed position on the lever 6; pick 21 is mounted for displacement by pivoting or translation in or by a guide element which is rigidly attached to the lever. This guide element determines the displacement of pick 21 from a close-together position to a spaced position of the end tappets 22 of picks 20 and 21 in the direction transverse to the track. The close-together position of the tappets 22 corresponds to the minimum length R desired for compacting of the ballast along the ties bearing the switch gear upon each plunge of the tools, the spaced position of the tappets 22 corresponds to the maximum length L desired for the compacting of the ballast along the ties on the open track, also upon each plunge of the tools.

In the first embodiment, shown in FIGS. 1 to 5, the displaceable pick 21 of each tool 4 is mounted for pivoting in a plane transverse to the track around a substantially horizontal axis and the guide element for this displacement consists of a shaft 23 which extends in the longitudinal direction of the track and is supported by two spaced brackets 24 rigidly fastened to the lever 6. The shaft 23 is firmly connected to a support 25 in which said pick 21 is fastened by force-fit. The pivoting of the pick 21 around the shaft 23 is both controlled and limited by a hydraulic cylinder 26 which bears on one side against the lever 6 and on the other side against an arm 27 which is rigidly connected to the support 25. The total stroke of the cylinder 26 is determined as a function of the amplitude of the displacement of the tappet 22 of the tool 21 in the direction transverse to the track corresponding to the distance L−R between the minimum length R and the maximum length L mentioned above. On the other hand, the other pick 20 of each tool 4 is mounted in fixed position on the lever 6 by direct force-fit in the latter In this first embodiment, the two tappets 22 are offset in the longitudinal direction of the track so that they can partially cover one another in close-together position, as can clearly be noted from FIGS. 2 and 4, this feature making it possible to obtain the greatest possible distance between the lengths R and L.

It will be noted here that in the spaced position of the tappets 22, which can be clearly noted from FIGS. 3 and 5, the maximum length L should preferably exceed the sum of the lengths of the two tappets only by an amount corresponding substantially to the particle size of the ballast, so that the ballast cannot escape between them. By creating the possibility of having them cover each other in close-together position it is thus possible to design them sufficiently long to cover more space in spaced position.

As seen in projection in a vertical plane transverse to the track, the two tappets 22 are offset towards each other with respect to the arms of the two picks 4 and the latter are arched towards the outside of the region which they occupy, the combination of these features, which can be clearly noted from FIG. 2, making it possible to free to the maximum the space U which separates them so as to permit the ballast to slide as freely as possible between them above the level of the tappets 22, in a region where specifically a compacting effect is not desired.

Seen in projection in a vertical plane longitudinal to the track, the two picks 20 and 21 of each tool 4 are arched one towards the other, as can clearly be noted in FIG. 1, so as to impart to their assembly the minimum size in this plane, but this feature is not indispensable and may be replaced by the bringing close together of their region of force-fit in the lever 6 and in the support 25.

Finally, the manner of displacement of the pick 21 by a hydraulic cylinder 26 makes it possible to pass from the close-together configuration to the spaced configuration of the tappets 22 by means of remote control, without the necessity of manipulation in situ, and also makes it possible to modulate this displacement, that is to say to select any desired length between the minimum length R and the maximum length L as a function of the variations in the insertion space available between obstacles.

From all of these features and their combined effects it results that this first embodiment is particularly indicated for use on tampers intended for intensive use, having high outputs and subject to severe regulations concerning the safety of their operators.

The second embodiment, shown in FIGS. 6 to 11, constitutes a simple and economical form which is applicable, preferably, to light tampers, such as those used for track and switch gear maintenance in stations. Only the tamping tool 4 and the lever 6 are shown in these figures in order not unnecessarily to clutter them. This tool 4 has two picks 20 and 21 force-fitted in two cylindrical housings 28 extending vertically in the oscillating and pivoting lever 6 and having a longitudinal slot 29 extending over their entire length and debouching towards the outside.

Each of the two picks 20 and 21 is locked in a selected angular position in its housing 28 by two tangential clamping screws 30 and 31 respectively.

The displaceable pick 21 is mounted for pivoting in a substantially horizontal plane, the guide element for this pivoting being formed here very simply by the cylindrical housing 28 in which it is force-fitted. The two clamping screws 31 of this pick 21 have a recessed head of large size intended to facilitate engagement by a suitable spanner while the two screws 30 of the other pick 20 are ordinary screws, since manipulation thereof is not useful upon changes in configuration.

Figure 7:
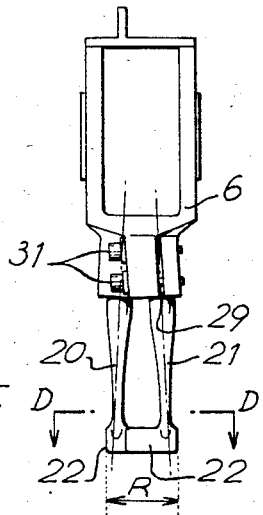
Figure 6:
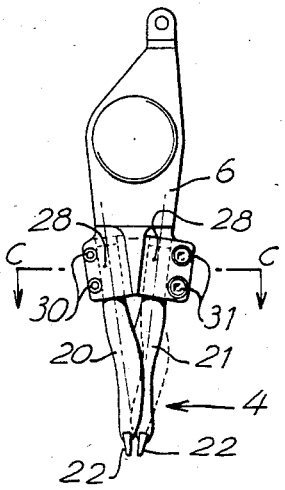
Figure 11:
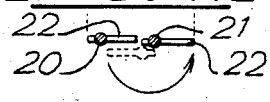
FIGS. 10 and 11 are a section along the line of D—D of FIG. 7 and a section along the line E—E of FIG. 8 respectively.
Figure 10:
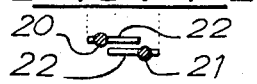
Figure 9:
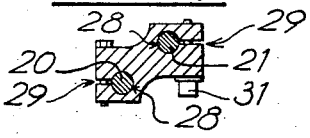
FIG. 9 is a section through same along the line C—C of FIG. 6.
Figure 14:
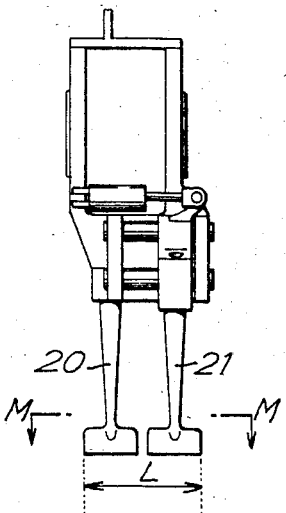
FIGS. 12, 13 and 14 are a side view and two partial front views respectively of the third embodiment, again shown in the same two configurations as the two preceding embodiments.
Figure 13:
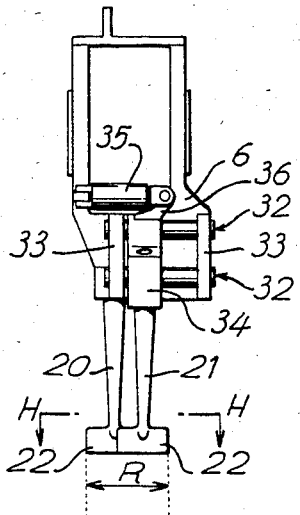

In the close-together position of the tappets 22, shown in FIGS. 7 and 10, the tappets are juxtaposed and partially cover one another in the longitudinal direction of the track and are offset towards each other with respect to the arms of the picks in the transverse direction, as in the first embodiment. The offset of these tappets is intended, on the one hand, to leave sufficient space between the two arms of these picks for the flow of the ballast and on the other hand to permit the passage from a close-together configuration to a spaced configuration shown in FIGS. 8 and 11 by simple pivoting of the pick 21 by 180° in its housing 28.

In the vertical plane transverse to the track corresponding to the plane of their tappets 22, the two picks 20 and 21 are not arched but straight, contrary to the preceding example, while in the vertical plane longitudinal to the track they are arched towards each other. This latter feature is useful here in order better to free passage for the ballast between the two thick upper parts of the picks, but it is not, however, indispensable.

In the third embodiment, shown in FIGS. 12 to 16, the pick 21 is displaceable by linear translation along a horizontal axis transverse to the track, spaced vertically apart and supported by two brackets 33 fastened rigidly to the oscillating and pivoting lever 6. The pick 21 is fastened by force-fit in a slide block 34 mounted movably on this slideway and driven by a hydraulic cylinder 35 bearing on one side against the lever 6 and on the other side against an arm 36 integral with said slide block 34. The total stroke of the slide block 34, limited by the two brackets 33, corresponds here to the difference L−R between the minimum length L desired. On the other hand, the other pick 20 of this tool is mounted in fixed position on the lever 6 by direct force-fit in the latter.

Figure 12:
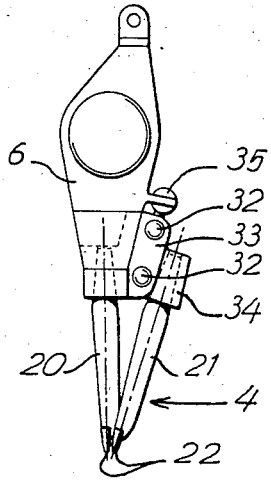
Figure 16:
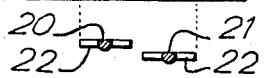
FIGS. 15 and 16 are a section along the line H—H of FIG. 13 and a section along the line M—M of FIG. 14 respectively.
Figure 15:
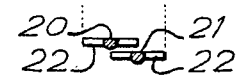

The two tappets 22 are offset in longitudinal direction of the track so that they are partially covered by each other in the close-together position, as in the two preceding examples, but in this case the two picks 20 and 21 are straight, parallel as seen in projection in a vertical plane transverse to the track (FIGS. 13 and 14) and divergent towards the top as seen in projection in a vertical plane longitudinal to the track (FIG. 12). The tappets 22 extend symmetrically with respect to the arms of their picks.

This third embodiment permits the use of traditional standard picks when the minimum length R desired is, however, sufficiently great so that the ballast can still flow freely between the arms of the picks above the tappets 22. Furthermore, the displacement by horizontal translation of the pick 21 causes the two tappets 22 to remain at the same level in both configurations, which may constitute an advantage when this effect is imperatively sought.

Variations may be made.

In the first embodiment, illustrated in FIGS. 1 to 5, the combination of the offset of the tappets 22 with the arched shape of the picks in the direction transverse to the track may not be indispensable. A single one of these two solutions can be employed to assure the free flow of the ballast between the picks when the dimensions of the tappets and picks permit this.

The number of displaceable picks 21 and their manner of displacement may vary on one and the same tool. Likewise, all the picks of a tool may be displaceable. Some of the possible variations of this type are illustrated in FIGS. 17 to 21, in which there are shown only in plan view the tappets with their picks and their pivot axis P when displacement of this kind is concerned.

Figure 17:
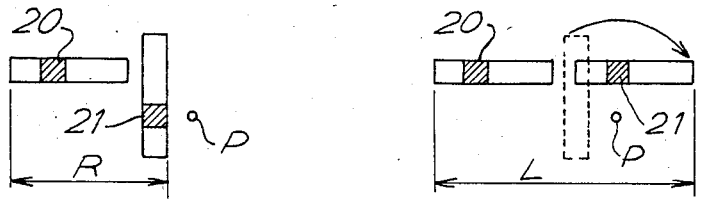
FIGS. 17 to 21 are diagrams which illustrate the five variants.

In FIG. 17, the tool comprises a fixed pick 20 and a pick 21 displaceable by pivoting through 90° around a substantially vertical axis P. This variant lends itself to drive by hydraulic cylinder.

Figure 18:
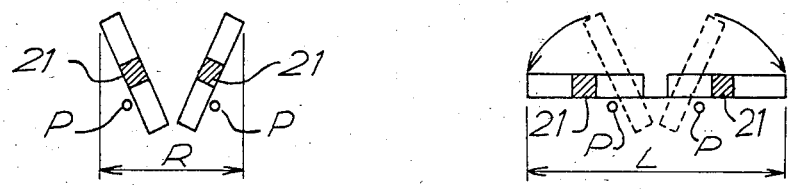

In FIG. 18, the tool comprises two picks 21 displaceable by pivoting by less than 90°. This variant also lends itself to drive by hydraulic cylinder.

Figure 19:
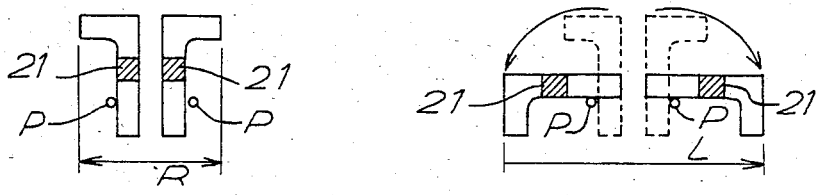

In FIG. 19, the tool has two picks 21 which are displaceable by pivoting by 90° and which can also be displaced by cylinders. In this variant, the tappets have two faces of unequal length at a right angle to each other and either one or the other operates.

Figure 20:
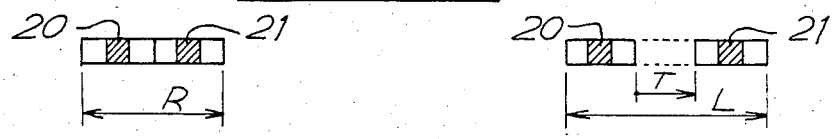

In FIG. 20, the tool has a stationary pick 20 and a pick 21 which is movable by translation T. This variant can also be mechanized. The tappets are either against each other or apart from each other. This variant is applicable when a limited flow of ballast between the two tappets is tolerated.

Figure 21:
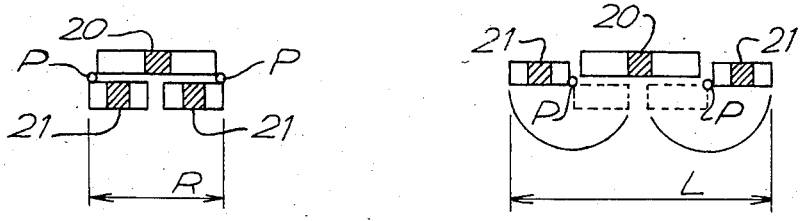

In FIG. 21 the tool comprises a fixed pick 20 and two picks 21 displaceable by pivoting by 180°, arranged on opposite sides of the fixed pick 20. This variant does not lend itself to mechanization by hydraulic cylinder and must be operated by the operator of the tamper, in the same way as in the second embodiment illustrated in FIGS. 6 to 11.

Figure 22:
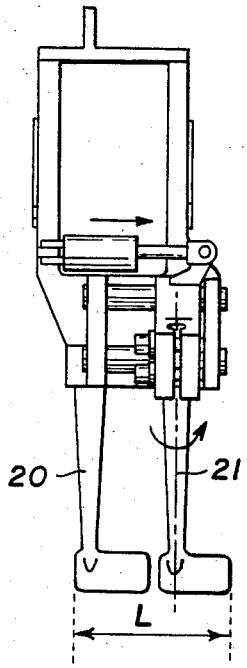
FIGS. 22 and 23 are two partial side views of the sixth variant shown in two different configurations.
Figure 23:
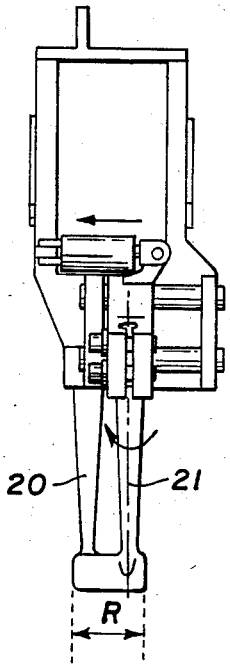

Finally, one can also contemplate a tool having picks which are displaceable by combined pivoting and translation, in which these picks move away from each other by translation on a slideway and turn on themselves so that their tappets can pass from a folded position to an extended position. This variant can be contemplated for large differences between the minimum length R and the maximum length L. It can, for instance, be obtained by combining the movement of rotation of the structure according to FIGS. 6 to 11 with the movement of translation of the structure according to FIGS. 12 to 16, as shown in FIGS. 22 and 23.

What is claimed is:

1. A railway track tamper for tamping switch gear as well as open track, comprising in combination:

(a) at least one tamping unit;

(b) a carrying frame mounted for vertical amount in said tamping unit;

(c) two levers mounted in opposition on said carrying frame, said levers being articulated on the carrying frame for oscillating and pivotal movement in a plane parallel to the direction of elongation of the track;

(d) at least two tamping picks mounted on each of said two levers, said two tamping picks forming in work condition on their respective lever one tamping tool located on one side of a line of rails of said track;

(e) an end blade on each of said tamping picks, the end blades of each of said tamping tools being juxtaposed at least in one of the directions transverse and parallel to the elongation of the track; and, (f) guide means and power means affixed to each of said levers to cause a pivotal movement of at least one of its tamping picks in work condition in a direction opposite to the other tamping pick, whereby the end blades of the tamping tool are at variable relative work positions in the direction transverse to the elongation of the track, between a close-together work position (R) corresponding to the minimum compacting length desired for each plunge of the tool into the ballast and a spaced work position (L) corresponding to the maximum compacting length desired for each plunge of the tool into the ballast.

2. A railway track tamper for tamping switch gear as well as open track, comprising in combination:

(a) at least one tamping unit;

(b) a carrying frame mounted for vertical movement in said tamping unit;

(c) two levers mounted in opposition on said carrying frame, said levers being articulated on the carrying frame for oscillating and pivotal movement in a plane parallel to the direction of elongation of the track;

(d) at least two tamping picks mounted on each of said two levers, said two tamping picks forming in work condition on their respective lever one tamping tool located on one side of a line of rails of said track;

(e) an end blade on each of said tamping picks, the end blades of each of said tamping tools being juxtaposed at least in one of the directions transverse and parallel to the elongation of the track; and, (f) guide means and power means affixed to each of said levers to cause a translational motion of at least one of its tamping picks in work condition in a direction opposite to the other tamping pick, whereby the end blades of the tamping tool are at variable relative work positions in the direction transverse to the elongation of the track, between a close-together work position (R) corresponding to the minimum compacting length desired for each plunge of the tool into the ballast and a space work position (L) corresponding to the maximum compacting length desired for each plunge of the tool into the ballast.

3. A railway track tamper for tamping switch gear as well as open track, comprising in combination:

(a) at least one tamping unit;

(b) a carrying frame mounted for vertical movement in said tamping unit;

(c) two levers mounted in opposition on said carrying frame, said levers being articulated on the carrying frame for oscillating and pivotal movement in a plane parallel to the direction of elongation of the track;

(d) at least two tamping picks mounted on each said two levers, said two tamping picks forming in work condition on their respective lever one tamping tool located on one side of a line of rails of said track;

(e) an end blade on each of said tamping picks, the end blades of each of said tamping tools being juxtaposed at least in one of the directions transverse and parallel to the elongation of the track; and, (f) guide means and power means affixed to each of said levers to cause a pivotal and translational motion of at least one of its tamping picks in work condition in a direction opposite to the other tamping pick, whereby the end blades of the tamping tool are at variable relative work positions in the direction transverse to the elongation of the track, between a close-together work position (R) corresponding to the minimum compacting length desired for each plunge of the tool into the ballast and a spaced work position (L) corresponding to the maximum compacting length desired for each plunge of the tool into the ballast.

4. A railway track tamper for tamping switch gear as well as open track, comprising in combination:

(a) at least one tamping unit;

(b) a carrying frame mounted for vertical movement in said tamping unit;

(c) two levers mounted in opposition on said carrying frame, said levers being articulated on the carrying frame for oscillating and pivotal movement in a plane parallel to the direction of elongation of the track;

(d) at least two tamping picks mounted on each of said two levers, said two tamping picks forming in work condition on their respective lever one tamping tool located on one side of a line of rails of said track;

(e) an end blade on each of said tamping picks, the end blades of each of said tamping tools being juxtaposed at least in one of the directions transverse and parallel to the elongation of the track; and, (f) pivotal mounting means affixed to each of said levers to hold and allow a pivotal movement of at least one of its tamping picks in work condition in a direction opposite to the other tamping pick, whereby the end blades of the tamping tool are at variable relative work positions in the direction transverse to the elongation of the track, between a close-together work position (R) corresponding to the minimum compacting length desired for each plunge of the tool into the ballast and a spaced work position (L) corresponding to the maximum compacting length desired for each plunge of the tool into the ballast.

* * * * *